United States Patent [19]

Ashikian

[11] Patent Number: 4,553,903

[45] **Date of Patent: * Nov. 19, 1985**

[54] TWO-STAGE ROTARY COMPRESSOR

[76] Inventor: Baruir Ashikian, 505, rue Frechette, Sherbrooke, Quebec, Canada, J1J 2V5

[ * ] Notice: The portion of the term of this patent subsequent to Jul. 17, 2001 has been disclaimed.

[21] Appl. No.: 627,634

[22] Filed: Jul. 3, 1984

Related U.S. Application Data

[63] Continuation-in-part of Ser. No. 460,843, Jan. 25, 1983, Pat. No. 4,460,319.

[30] Foreign Application Priority Data

Feb. 8, 1982 [CA] Canada ..... 395794

[51] Int. Cl.[4] ..... F04B 23/10; F04B 1/12; F01B 13/04

[52] U.S. Cl. ..... 417/204; 417/205; 417/206; 417/269; 417/486

[58] Field of Search ..... 417/204, 205, 206, 269, 417/486

[56] References Cited

U.S. PATENT DOCUMENTS

| | | | |
|---|---|---|---|
| 562,382 | 6/1896 | Filtz . | |
| 2,020,611 | 11/1935 | Knapp . | |
| 2,150,122 | 3/1939 | Kollberg et al. . | |
| 2,504,841 | 4/1950 | Jones . | |
| 2,604,047 | 7/1952 | Beaman et al. | 417/206 |
| 2,780,170 | 2/1957 | Stoyke et al. | 417/206 X |
| 2,992,616 | 7/1961 | Rineer . | |
| 3,664,772 | 5/1972 | Panariti | 417/269 |
| 3,762,841 | 10/1973 | Savikurki | 418/13 |
| 3,905,204 | 9/1975 | Edwards | 418/13 C |

FOREIGN PATENT DOCUMENTS

| | | |
|---|---|---|
| 1108009 | 9/1981 | Canada . |
| 1056935 | 5/1959 | Fed. Rep. of Germany . |
| 352526 | 7/1931 | United Kingdom . |

*Primary Examiner*—Richard E. Gluck
*Attorney, Agent, or Firm*—Finnegan, Henderson, Farabow, Garrett & Dunner

[57] ABSTRACT

A two-stage rotary compressor makes use of a piston-vane arrangement where both stages are built end to end and where the same members (piston-vanes) work for both stages, the "axial pistons" of the second stage becoming the dividing "vanes" in the first stage.

31 Claims, 20 Drawing Figures

TWO-STAGE ROTARY COMPRESSOR

CROSS REFERENCE TO RELATED APPLICATION

This is a continuation-in-part of U.S. Ser. No. 460,843 filed Jan. 25, 1983, now U.S. Pat. No. 4,460,319.

FIELD OF THE INVENTION

The present invention relates to two-stage fluid displacement apparatus, particularly two-stage compressors.

BACKGROUND OF THE INVENTION

The power saving obtained in two-stage compression with intercooling is a well known fact but double-staging is usually applied for high pressure ratios and for important size units. The ever increasing energy cost leads to the increased use of two-stage compressors in the field of modest pressure ratios such as encountered in shop air requirements and in that of small units. Another factor to influence selection of the compressors, pumps, etc., is the increased use of variable speed a.c. electrical motors which may provide power savings by varying the compressor speed in response to the requested output. These two factors are unlikely to favour the existing rotary compressors available on the market i.e. the oil flooded vane type and the dry or oil flooded screw type.

Vane compressors already available in two-stage designs suffer from several drawbacks: high leakage area, hence high oil circulation for a given displacement; high rubbing speeds; vane sticking problems which imply the necessity of operating within a narrow range of rotational speed; and an overall high power consumption.

Screw compressors, although popular, are seldom used for two-stage operations because they usually require two complete separate units sometimes interconnected via an intercooler with the result that this leads to an expensive arrangement. Moreover, its performance is dependent upon its rotational speed and, therefore, output control via speed control will not produce any significant power saving.

The above mentioned techniques would favour the classical reciprocating compressor which, when properly designed, has an inherent ability to operate over a wider range of speeds and has less power consumption than the equivalent two rotary volumetric compressors.

A rotary compressor with less leakage area than that in the vane compressor, with double-staging at reasonable cost and with the ability to operate at various speeds while maintaining a satisfactory performance, will maintain a continued competitive edge over the reciprocating compressor.

OBJECTS AND STATEMENT OF THE INVENTION

It is an object of the present invention to overcome the drawbacks of the above mentioned rotary compressor types by providing a rotary compressor where both stages are built side-by-side or end to end in the same assembly thus resulting in a compressor which is compact and has a minimum number of parts thereby causing less friction and being of lower cost. In the compressor of the present invention, the same members (piston-vanes) work for both stages, the dividing "vanes" in the first stage becoming the "axial pistons" of the second stage. The compressor first stage may make use of a vane arrangement similar to that described in applicant's Canadian Pat. No. 1,108,009 issued Sept. 1, 1981 and entitled "Rotary axial vane mechanism".

It is another object of the invention to provide a rotary fluid displacement motor. Although the detailed description hereafter is concerned mainly with compressors, those skilled in the art will realize that with a few modifications, the fluid displacement apparatus described herein can function as a motor when supplied with fluid from a high pressure source to provide a useful mechanical output.

Thus, the invention in one aspect provides: a rotary fluid displacement apparatus having first and second stages and comprising: a first body and a second body, one of which is held stationary; means defining an axis of relative rotation between said bodies; a plurality of piston-vanes mounted in said first body for reciprocating movement relative thereto; the second body having cam means co-acting with said piston-vanes such that the reciprocating movement of said piston-vanes occurs in the course of relative rotation between said bodies about said axis; one of said stages including a plurality of closed working chambers defined at least in part between adjacent portions of said piston-vanes, said cam means and portions of said first body, and all being arranged such that the volumes of said chambers increase and decrease in cyclical fashion during said relative rotation; the other stage including a plurality of closed working chambers comprising elongated bores in said first body in each of which a respective one of said piston-vanes is slidably mounted in sealing engagement with the wall of such bore, with the volumes of said last mentioned working chambers varying in cyclical fashion as said piston-vanes reciprocate in said bores during said relative rotation between said bodies; and first and second stage inlet and exit port means for admitting and releasing fluid from the working chambers of the two stages in the course of said relative rotation and means defining a path for transmitting the fluid from the first stage to the second stage of the apparatus.

The apparatus described above is preferably arranged to operate as a compressor in which event said cam means effects the recriprocation of the piston-vanes in response to said relative rotation, said one stage being the first stage, and said other stage being the second stage of the compressor.

In a preferred form of the invention, said piston-vanes are equally angularly spaced apart around said axis of relative rotation at a substantially equal distance from said axis; furthermore said piston-vanes reciprocate in straight-line paths parallel to said axis of relative rotation.

As described hereafter said piston-vanes are each of circular section to allow for the rotation thereof relative to said first body during the relative rotation between said two bodies.

The above-noted cam means may include a surface lying in a plane inclined at a selected angle to the axis of relative rotation, such plane surface slidingly, sealingly engaging end portions of said piston-vanes. Preferably, said cam means are arranged to engage opposing ends of each of said piston-vanes to effect the relative reciprocating motion thereof during said relative rotation.

In a preferred form of the invention the first body has a frustro-conical surface defining a part of the working chambers, with a portion of said frustro-conical surface being in sliding, sealing contact with said inclined planar surface of said cam means. The first stage working chambers may be defined in part by the inclined planar surface of said cam means with said piston-vanes each having inclined ends adapted to remain in continuous sliding contact with said inclined planar surface.

The compressor first stage inlet and exit ports are preferably defined in said inclined planar surface with the flow of fluid therethrough being controlled as the inclined ends of the piston-vanes slide thereover. The planar surface may be defined by a first stage head, and said cam means may further include an inclined cam plate parallel to said planar surface, said piston-vanes being confined between said planar surface and said inclined cam plate.

As described more fully hereafter, suitable means are provided for closing the ends of the bores of said second stage working chambers. Each of said piston-vanes includes two coaxial adjoining portions of different outside diameters, the larger portions being substantially equal to the inside diameter of the elongated bore and the smaller portion traversing said end closure means of said bore; said piston-vane portions have free ends lying in planes parallel to each other and inclined with respect to the common longitudinal axis thereof, the other end of said larger portion being perpendicular to said axis and coming into close proximity to the end closure means during operation to provide good volumetric efficiency. During operation, the inclined end of said larger portion remains in substantially continuous sliding contact with the inclined planar camming surface of said first-stage head, and the inclined end of said smaller portion remains in substantially continuous sliding contact with said inclined cam plate; the relative rotation between said bodies causes the rotation of said piston-vanes around their own axes and their longitudinal reciprocation in said bores.

Further according to the invention, each said second stage working chamber includes a single inlet-exit port therein, and means arranged in sliding, sealing engagement with said inlet-exit ports to selectively open and close the same to admit fluid from said first stage and to release fluid therefrom to said second stage outlet means in cyclical fashion during the relative rotation between said first and second bodies. The means to selectively open and close said inlet-exit ports preferably comprises a hollow collector located at said axis of relative rotation and having angularly arranged admission, compression, exhaust and sealing sectors which cooperate with the inlet-exit ports of said cylinders.

In one version of the invention, said first body in which said piston-vanes are mounted is a rotor and said second body having said cam means is fixed in position during operation. In this case the second body includes a casing and said cam means are located adjacent opposite ends of said casing; and an axially extending shaft is connected to said rotor for driving the same. The fixed second body may include an axially extending boom about which said rotor revolves, said boom having openings therein providing said means for selectively admitting and releasing fluid from said second stage working chambers.

The compressor described above may include means for cooling said fluid between said stages, said means including an annular coil surrounding said rotor.

A further version of the invention provides a double acting two-stage compressor including two sets of said piston-vanes, the first and second sets co-operating with respective ones of said cam means at the opposite ends of said casing such that first stage working chambers are defined adjacent each of said opposing ends of the casing.

In a still further version of the invention said first body in which said piston-vanes are mounted is fixed during operation and said second body having said cam means is a rotor. In this version said rotor includes a shaft connected to said cam means for rotating the same to effect the reciprocating motion of the piston-vanes. Also, the above-noted hollow collector is fixed to and rotates with said shaft.

As a desirable maintenance feature wherein each of said elongated bores is closed by a removable end cap thereon arranged to permit said piston-vanes to be individually removed without disassembly of the first stage of the compressor.

In order to reduce friction and wear, oil passages may be provided for supplying pressurized oil to the interior of each said piston-vane, each piston-vane having an opening in its inclined end portion which slidably engages said inclined planar surface to supply a cushion of oil to the interface between said end portion and planar surface. Higher operating speeds and pressures are thus permitted.

Further features of the invention in its various aspects are more fully set out in the claims appended hereto.

The scope of applicability of the present invention will become further apparent from the detailed description given hereinafter; it should be understood, however, that this description, while indicating preferred embodiments of the invention, is given by way of illustration only since various changes and modifications within the spirit and scope of the invention will become apparent to those skilled in the art.

DETAILED DESCRIPTION—SINGLE ACTING COMPRESSOR

Figures 1, 10, 11:
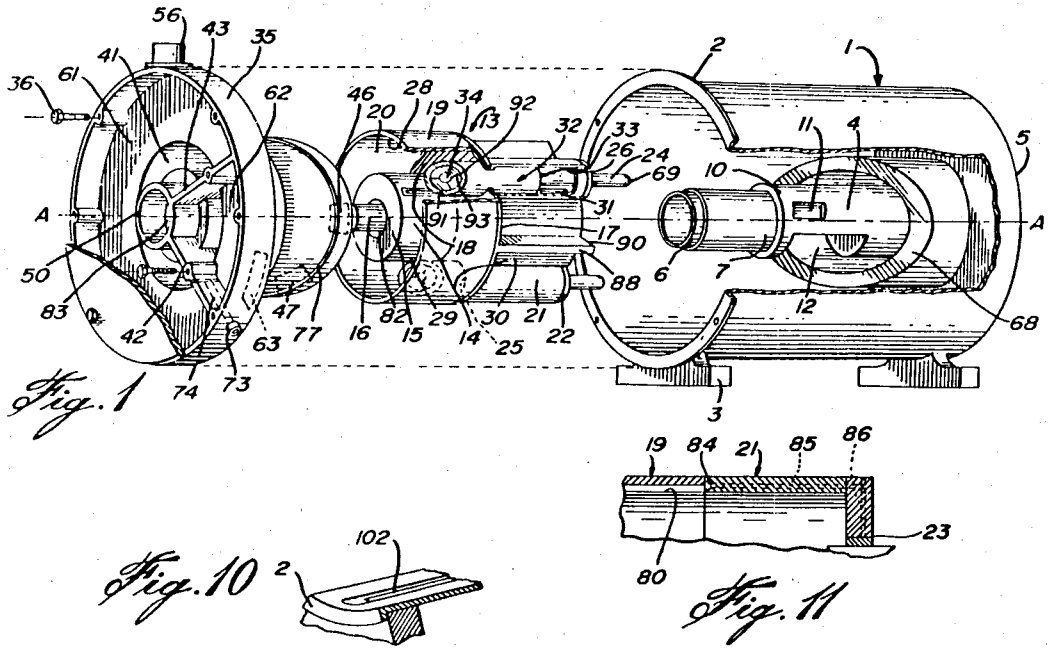
FIG. 1 is an exploded perspective view, with parts partially broken away, showing one version of a single acting two-stage compressor made in accordance with the present invention (the cooling means have been removed for clarity)
FIG. 10 is an enlarged perspective view of a groove in the casing; this figure is shown on the same sheet as FIG. 1.
FIG. 11 is an enlarged partial cross-sectional view, in the region of the cylinders, of the rotor sleeve seated on the rotor; this figure is shown on the same sheet as FIG. 1.
Figure 8:
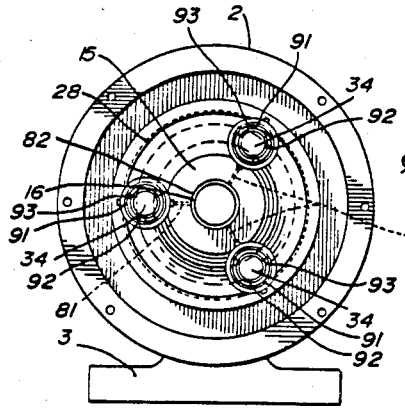
FIG. 8 is a front elevational view showing the single acting compressor with the first-stage head and intercooler coils and baffles removed; this figure is shown on the same sheet as FIG. 2.
Figure 9:
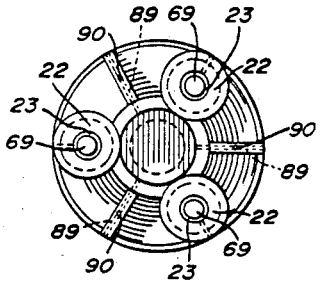
FIG. 9 is an end elevational view of the rotor; this figure is shown on the same sheet as FIG. 2.
Figure 2:
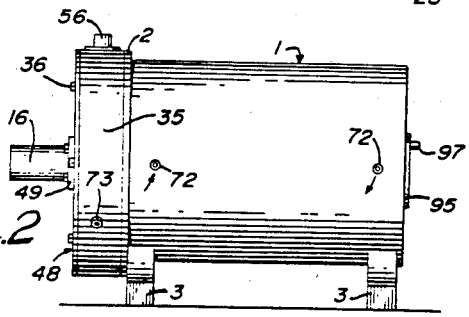
FIG. 2 is a side elevational view of the compressor shown in FIG. 1.

The casing 1 consists of a substantially cylindrical drum having a longitudinal axis A—A; the drum has a flange 2 at its open end, legs 3 for bolting down the compressor to its supporting frame (not shown) and a center boom 4 which protrudes inwards from the end wall 5. The drum walls and the flange are thick enough to withstand the first stage discharge pressure as explained below. The oil tank (not shown) is usually bolted directly to the underside of the legs and communicates with the interior of the casing and the cavity collecting the second stage output. The center boom 4 consists of several thick walled cylindrical portions concentric to and located along the axis A—A, the outermost portion 6 acting as a bearing seat and being closed at its end, while a second portion 7, closer to the end wall acts as the seat for a second bearing. Next to the second portion, the boom has an upper cylindrical surface 10 concentric with the axis A—A; this surface extends over an arc of 210° and has a port 11 which collects the gas-oil mixture discharged from the second stage cylinders as described below. The cylindrical sector 10 is completed with a recessed intake sector 12 through which passes the gas of the intercooler before being admitted in the second stage cylinders. A rotor 13 is mounted on the center boom 4; it has an inner hollow cylinder 14 which contains the bearings 8 and 9 seating, when assembled on the respective seats 6 and 7 on the boom. The cylinder 14 is closed at one end with a wall 15 to which is attached a drive shaft 16. The rotor also contains:

an annular wall 17 located at midlength around the outer periphery of the cylinder 14; this wall has a conical surface 18 pointing towards the shaft end;

a cylindrical sleeve 19 concentric with the inner cylinder 14, this sleeve joining the outer periphery of the conical surface 18 and thereby creating an annular open ended space 20;

several equally spaced hollow cylinders 21 with their longitudinal axis parallel to A—A; these cylinders join the outer periphery of cylinder 14 and the back of the annular wall 17 and each is closed at its free end with a cover 22 equipped with a center bushing 23 through which reciprocates and rotates a piston-rod 24 concentric with the bore of the cylinder 21.

The opened ends of these cylinders communicate with the annular space 20 via circular openings 25 in the annular wall 17 and the conical surface 18. The bores 26 in the cylinders 21 exceed the width of the annular space 20 and extend into the annular space almost over its entire length thereby creating a circular arc recess 27 in the inner surface 28 of the cylindrical sleeve 19 and a circular arc recess 29 in the outer surface 30 of the hollow cylinder 14.

Each cylinder 21 contains, next to its cover 22, a port 31 which establishes a communication between the inside of cylinder 21 and the interior of the boom 4 via port 11. When the rotor rotates around the center boom, ports 31 contact, successively, the intake and collecting sectors thereby admitting and then expelling the gas-oil mixture into and out from the second stage cylinders.

Located within each bore 26 is a light-weight circular piston-vane 32 which has a straight end 33 with piston-rod 24 protuding therefrom and an inclined plane end 34 making with the axis A—A an angle equal to the apex angle of the conical surface 18; the piston-rod also ends with an inclined plane 69 parallel to end 34.

Each piston-vane slides with very little radial play within its corresponding bore and corresponding recessess in surfaces 28 and 30. For every full rotation of the rotor, the piston-vane executes a complete axial back and forth stroke and a complete rotation around its own axis by virtue of the action of the cam means described hereafter.

The first-stage head 35, which is bolted to the flange 2 with bolts 36, carries on its inner face an annular protrusion 37 consisting of two concentric walls 38 and 39 and an inclined wall 40 which closes the inner end of the annular protrusion 37; the walls 38, 39 and 40 define an annular space 41 which extends toward the open end of the head and which is divided in two compartments 61 and 62 by two webs 42 and 43.

The inclined wall 40 has an inclined plane camming surface 44 which makes with the axis A—A an angle equal to that of the apex angle of the conical surface 18. When installed, the annular protrusion penetrates with little radial clearances into the annular space 20 of the rotor.

The inclined plane camming surface 44 carries at its highest point a shallow conical radial recess 45 of a width inferior to the diameter of the bores 26; when assembled, the inclined plane of the first-stage head and the conical surface of the rotor remain in continuous sliding contact along the recess 45.

Openings 46 in the inclined wall, next to the recess 45 acts as an outlet port for the first stage; other openings 47 located on the other side of the recess acts as an inlet port for the first stage.

Each of these ports communicates with one of the compartments created by the webs 42 and 43, these compartments being covered with a first stage cover 48 secured with the same bolts 36. This cover has a hub 49 which extends the hub 50 of the first-stage head.

Figures 3, 6, 7:
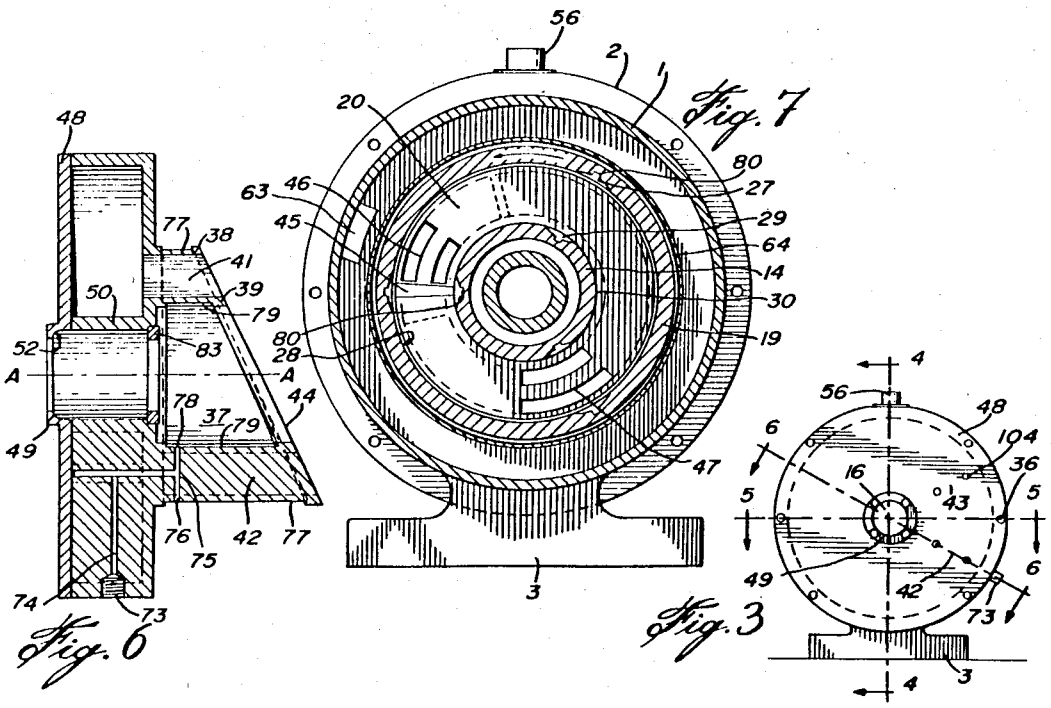
FIG. 3 is an end view of the compressor as seen from the left of FIG. 2.
FIG. 6 is a cross-sectional view of the first stage head of the compressor, taken along lines 6—6 of FIG. 3; this figure is shown on the same sheet as FIG. 3.
FIG. 7 is a cross sectional view taken along lines 7—7 of FIG. 4 and is shown on the same sheet as FIG. 3 (the cooling coils and baffles have been removed for clarity)
Figure 5:
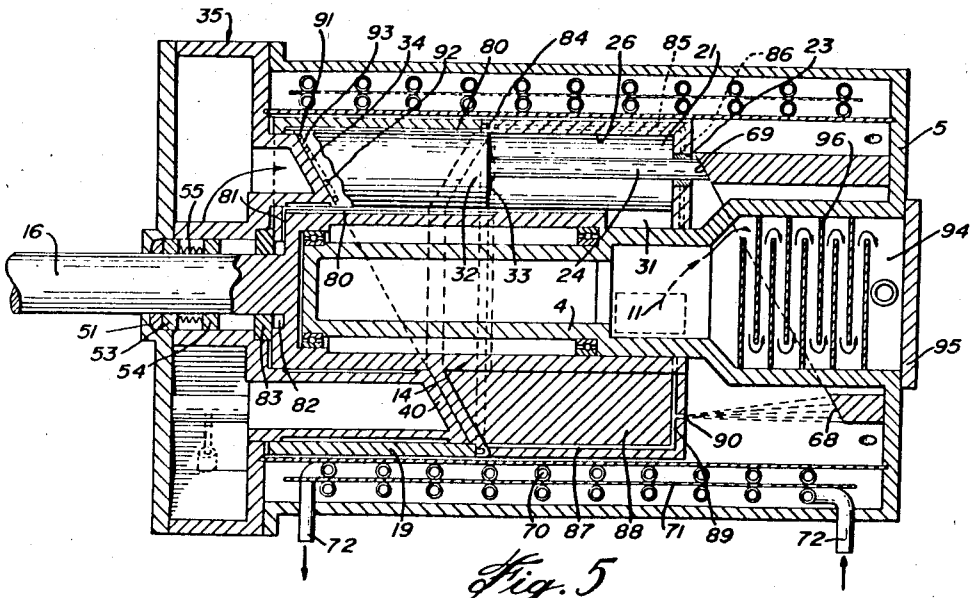
FIG. 5 is a cross-sectional view taken along lines 5—5 of FIG. 3.

The drive shaft 16 traverses these hubs and is surrounded by several parts making an axial seal assembly (see FIG. 5 and FIG. 6);

a stationary seat 51 with a spherical back engaging a corresponding spherical cavity 52 in the hub 49;

this arrangement provides good alignment and no leaks;

a face seal 53 rotating with the shaft; a back-up ring 54 which contains several springs 55 pushing the face seal against the seat.

A short duct 56 installed at the top of the first-stage head acts as the admission port to the first stage. Located within this duct is a check valve assembly consisting of a seat 57, a disc 58, a rod 59 and a spring 60.

The duct 56 communicates with the compartment 61 which in turn communicates with the openings 47 in the inclined wall 40. The compartment 61 acts as a "plenum chamber".

The second compartment 62 which communicates with the outlet ports 46, also communicates via a passage 63 with the interior of the casing, this passage 63 being located close to the inner surface of the casing.

The rotor is surrounded with a concentric cylindrical sleeve 64 which is supported in a circular groove 65 in the first stage and in a circular groove 66 in the end wall 5. The sleeve has several large holes 67 which face the second stage intake section.

The boom 4 is surrounded by a tubular cam 68 which seats with its straight end on the end wall 5 and exposes an inclined plane surface towards the rotor's second stage end. This inclined plane surface is parallel to the plane camming surface 44 of the first-stage head. The piston-rods which are provided with inclined plane ends 69 are continuously guided by the cam 68. Surface 44 and cam 68 both define cam means effecting reciprocation and rotation of the piston-vanes 32 as the rotor rotates.

Located between the sleeve 64 and the cylindrical wall of the casing are several concentric coils of tubing 70 separated by cylindrical baffles 71 and connected with their extremities to fittings 72, one of which admits a cooling fluid while the second discharges it.

The cooling fluid may be plain tap water or a coolant circulating through a low pressure radiator.

A well designed oil distribution system is important for the proper operation of the compressor because the oil fulfills many important functions: lubrication, sealing, cooling, pressure balancing.

The oil is delivered under pressure by a pump (not shown) to the oil inlet fitting 73 located on the first-stage head. The existence of this pump eliminates the need for maintaining a minimal discharge pressure when the compressor continues to operate "unloaded". A passage 74 in web 42 brings the oil to a radial passage 75 which communicates via a hole 76 with the oil cavity 77 in the outer periphery of the wall 38 and via a hole 78 with the oil cavity 79 in the inner periphery of the wall 39.

The oil from these cavities passes in the recesses 27 and 29 each of which contains a longitudinal oil groove 80 extending all the way to the annular wall 17.

Each recess 29 communicates via a radial hole 81 made in the drive end wall 15 with an annular cavity 82 surrounding the drive shaft at its junction with the wall 15. Closing this cavity is an axial balancing ring 83 fitted in the hub 50 of the first-stage head.

The oil grooves 80 in the recesses 27 communicate with an annular cavity 84 made in the annular wall 17 at the base of the sleeve 19. This cavity 84 feeds in turn three longitudinal oil holes 85 made in the wall of each high pressure cylinder 21; each hole 85 communicates in turn with a radial hole 86 made in the corresponding cover 22, this hole feeding the bushing 23.

The cavity 84 also feeds three longitudinal holes 87 in the three webs 88; each hole 87 communicates in turn with a radial hole 89 ending in the cylindrical bore surrounding the collector sector 10.

Each radial hole 89 connects with a short axial hole 90 located at a radius corresponding to the average radius of the cam.

Each vane has in its inclined place face 34, an outer circular oil groove 91 which contacts continuously the circular arc recesses 27 and 29; and an inner circular groove 92 joined to 91 by several radial grooves 93.

The boom cavity 94 is closed by a cover 95 which supports a baffle assembly 96 inserted in the cavity. The cover has an outlet opening 97 which communicates with a gas-oil separator (not shown). The oil accumulated in the cavity 94 is expelled through a passage 98 equipped with a float 99 controlling the outflow of oil via an orifice 100 starting with a seat 101; this orifice in turn communicates with an oil tank (not shown). The oil accumulating in the casing 1 is channelled through the drain channel 102 to the passage 103 which communicates with the oil tank already mentioned.

For easy inspection and replacement of piston-vanes, the first-stage head can be pulled over four maintenance rods which are installed in four holes in the flange 2 when the bolts 36 have been removed. With the first-stage head pulled away from the casing and resting on the rods, the piston-vanes can be inspected and should it be necessary to replace them, then the rotor is pulled from the casing (into the first-stage head resting on the rods) thereby exposing the covers 22 which once removed will allow replacement of piston-vanes.

OIL SYSTEM OPERATION

The oil under pressure arriving into the cavity 77 follows several paths:

fills the recesses 27 and the oil grooves 80 found in these recesses; it escapes via the vane-recess clearance and also through the outer circular groove 91 from which it passes also to the inner circular groove 92; finally it escapes via the vane-head—inclined plane clearance;

it also escapes via the clearance between the outer periphery of the wall 38 and the inner periphery of the sleeve 19.

The oil under pressure arriving into the cavity 79 follows several paths;

fills the recesses 29 and the oil grooves 80 found in these recesses, it escapes via the vane-recess clearance and also through the outer circular groove 91 from which it passes also to the inner circular groove 92; finally it escapes via the vane-head—inclined plane clearance;

it also escapes via the clearance between the inner periphery of the wall 39 and the outer periphery of the cylinder 14.

The oil reaching the vanes seals, lubricates, cools and provides a hydrostatic thrust force on the vane-head, this force being almost equal to the highest axial loads encountered by the piston-vane unit, thereby leading to low friction and insignificant wear.

The oil which fills the cavity 82 exerts a hydrostatic force against the overall axial force exerted on the rotor and the balancing ring 83 allows a limited leak past the annular surface facing the rotor.

The oil arriving from the cavity 84, via holes 85 and 86, emerges in the bushings 23, which, in this way, are kept well lubricated and allow for longtime, wear-free operation of piston-rods.

The oil arriving from the cavity 84, via holes 87, 89 emerges in the very small clearances between the collector's surface and the cylindrical bore surrounding it; grooves in the collector's surface assure a seizure free operation. The small axial branch 90 creates a spray of oil directed to the inclined surface of the cam 68, hence lubricating the piston-rods ends 69.

Additional lubrication, sealing and cooling are obtained by the oil carried by the gas itself.

The oil draining from the first stage and that from the second stage (via a float control) are both cooled, filtered and reintroduced in the compressor after having passed through a pump which boosts the pressure to a value exceeding that of discharging gas-oil mixture from the second stage. Cooler, filter, pump as well as the oil pressure relief valve may all be installed within, on or around an oil tank which might be directly bolted to the casing legs 3.

Oil flow metering in various branches is achieved with adequate restrictions.

Both the intercooler section of the casing and the boom cavity 94 are protected with pressure relief valves set to the desired pressures; the return of these valves is the first stage inlet compartment 61.

The cooling obtained by the oil injected in the compressor at various locations reduces the discharge temperatures and the power consumption; it tends to maintain a good viscosity for the oil.

The fact the the intercooler coil surrounds the rotor helps in attenuating the noise level and, because of the continuous cooling action, the compressor can operate for extended periods even if "unloaded".

When the compressor is stopped with gas-oil under pressure both in the gas-oil separator and the casing (the receiver is isolated by a check valve between itself and the gas-oil separator), this gas would tend to turn the compressor into a motor with the gas discharging through the first stage inlet. This action is prevented by the check valve 58 installed in the inlet duct. The pressure would gradually drop if all the leaks are not completely eliminated (which is always the case) but the "motoring" action will definitely not take place.

LEAKAGE CONSIDERATIONS

For the present compressor, as for any other rotary compressor where mechanical sealing is difficult and expensive to use, the clearances between all the surfaces in relative motion must be sufficiently small to avoid excessive leaks between regions of different pressures and, at the same time, large enough to allow for unimpeded operation in the presence of thermal expansion, slight vibration, etc.

Since leakage is proportional to the pressure difference and the leakage area, it is of utmost important to leave a minimum area when dealing with high pressure differences. This requirement is often in contradiction with the basic design encountered in the rotary compressors, particularly in the vane types where leakage peripheries at high pressure are still too large and require large quantities of oil for obtaining adequate sealing. Or to much oil causes increased power consumption.

In my invention, the double staging in a single rotor offers two advantages: that of the power saving resulting from intercooling and that resulting from the use of two different designs of working chambers, each best suited for the pressure differences encountered in the two-stages.

In the first stage the working chambers occupy the annular space 20 closed by the inclined plane camming surface 44. Their number exceeds by one that of the piston-vanes used; the "extra" chamber disappears when a vane slides past the radial recess 45. As the rotor turns, the volumes of the working chambers vary cyclically from zero to a maximum and then back to zero.

The leakage areas are found at:

- the inner and outer peripheries 28 and 30 of the annular space 20 and at the radial recess 45 for the inclined plane-rotor interface;
- the circular arc recesses 27 and 29 and at the circular openings 25 for the piston-vane—rotor interface;
- the gap between the inclined plane surface 44 and the inclined plane faces 34 of the vanes 32, for the vane-inclined plane interface.

Because the pressure differences in the first stage are quite small the resulting leakage remains acceptable.

In the second stage the working chambers are confined within the high pressure cylinders 21 which occupy the second half of the rotor 13. Their volumes vary cyclically from zero to a maximum and back to zero because the pistons 32 are forced to execute a reciprocating axial travel. The leakage areas within the cylinder are very small: the largest one is located at the gap between the cylinder outlet port 31 and the collector 10 and to minimize it, the surfaces must be well finished and the clearances kept to a minimum. The last condition requires an accurate assembly and in the present compressor this is achieved by supporting the rotor on two large bearings seating on the same rigid boom. Moreover, the collector is situated next to one of the bearings.

The overall leakage from the stages is reduced by surrounding the entire rotor with the intercooler; this arrangement offers simplicity and compactness by eliminating a separate intercooler with outside connections and offers a minimal pressure drop between stages. This leakage is further reduced by the fact that oil under pressure is injected into all the above mentioned leakage areas in a minimal quantity with a maximal effect.

OPERATION

When the compressor is fully assembled, the piston-vanes take axial positions dictated by the cooperating camming action of the inclined plane surface 44 and that of the cam 68 which engage the opposing ends of the piston-vanes.

As the rotor is turned, the lightweight vanes 32 slide with their inclined place faces 34 over the inclined plane camming surface 44 while the piston-rod ends 69 remain in contact with the cam 68.

The inclined plane surface 44 maintains a continuous sliding contact in the radial recessed portion 45 with the conical surface 18, thereby leading to an operation with zero clearance volumes, hence with high volumetric efficiency in the first state.

The gas to be compressed is admitted in the first stage chambers through the inlet duct 56, past the check valve 58 which opens with a very small pressure difference, through the inlet ports 47 which is positioned in a way to ensure complete filling of the working chambers when they have reached their maximum volumes and which is large enough for filling with very low pressure drop. The entire inlet section attenuates the entrance noise to a level which would even eliminate the need for a sound-proof enclosure. An added sound attenuation results from the use of air inlet filters (not shown). As the working chamber volume decreases from this maximum value, the gas is compressed and when the pressure between two consecutive vanes reaches the intercooler pressure value, the leading vane uncovers the outlet ports 46 and for the next approximate 50° of rotation, the compressed gas mixed with the injected oil is fully discharged into the outlet chamber 62 and from there, through the passage 63 into the annular space reserved, inside the casing, for the cooling coils 70.

The gas-oil mixture travels between the coils, is cooled and emerges partly separated through the holes 67 of the sleeve 64. It is then admitted in the second stage cylinder 21 via the intake sector 12 on the centre boom and via the ports 31.

The outside diameter of the piston-rods 24 is such that the pressure inside the high pressure cylinders is equal to that in the intercooler at the beginning of the compression stroke. This pressure in turn is maintained at its best value by the pressure control valve 104. This action ensures minimal power consumption and involves a small quantity of high pressure gas bled into the inlet plenum chamber. Various final discharge pressures can be obtained by simply changing the piston-rod diameter and the covers 22.

During the first half of the compression stroke the port 31 passes over the closed section of the collector 10 and the pressure increases gradually to that of the final discharge value.

During the second half of this stroke, the port 31 communicates with the port 11 and the entire gas-oil mixture within the second stage cylinder passes into the boom cavity 94 where most of the oil drops out of the mixture because of the baffles 96; the oil collected in this manner passes into the oil tank via the float controlled orifice 100. The gas with very little oil is discharged into a gas-oil separator via the outlet opening 97.

The existence of several working chambers and lightweight piston-vanes ensures a pulsation free discharge and leads to an operation with small torque variations, full radial balance and a very small axial unbalance.

Since the piston-vanes are the only wearing parts (besides the bearings) and since their replacement cost is quite modest, the compressor offers an operation with low cost maintenance.

DOUBLE ACTING COMPRESSOR

Most of the previous descriptions and explanations fully apply to the double action compressor. The common parts which appear on FIG. 12 (which is in fact a modified version of FIG. 1) are not numbered to avoid unnecessary repetition. The added and the modified components are properly identified and referred to in the following description.

Figure 12:
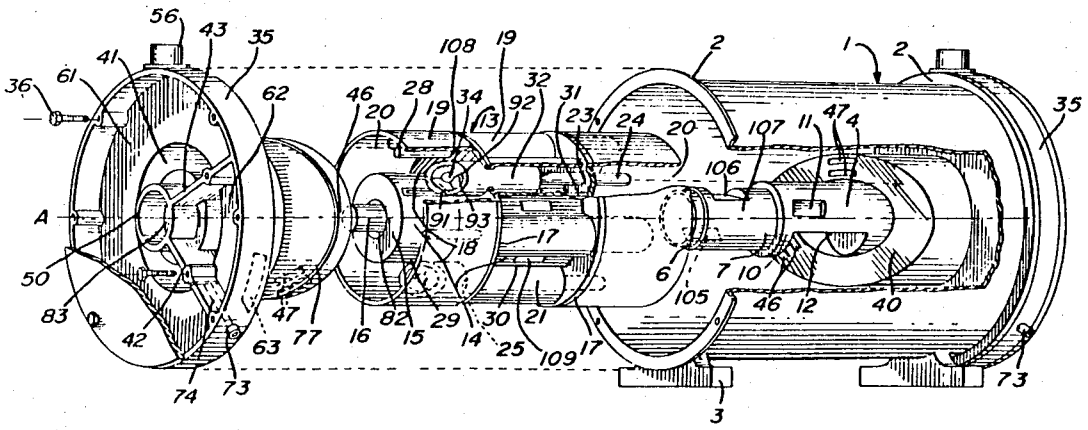
FIG. 12 is an exploded perspective view with parts partly broken away of a double acting compressor, (the cooling means have been removed for clarity)

As seen from the FIG. 12, the casing 1 has a second flange 2 to which is bolted a second first stage head 35 in many respects similar to that at the drive end. The two heads face each other with their inclinded walls 40 parallel to each other. While the drive end head accommodates the drive shaft emerging from the rotor, the added head holds the centre boom with all its arrangements seen in FIG. 4 and FIG. 5 with respect to the collection of air-oil, its separation, the discharge of air and oil etc.

The centre boom 4 contains, in addition to the collector sector 10 with the ports 11 and 12, a second collector sector 107 with ports 105 and 106 located at 180° with respect to 11 and 12. This added pair of ports near the first rotor support bearing serves the added set of three second stage cylinders 21 which replace the webs 88. The cylinder core 14 contains an added annular wall 17 with its own conical surface 18 and an added cylinder sleeve 19 which creates a second open ended space 20 facing the second first stage head. Each annular wall 17 contains at 60° intervals, three large diameter openings 25 and three smaller diameter openings 108, these two sets having the same circle for their centers. A large opening in a wall 17 is axially paired with a small opening in the other wall 17; each pair registers with the longitudinal axis of a hollow cylinder 21 which contains a piston-vane 32 identical to those already described. The large cylindrical portion slides in the respective annular cavity 20 and the large opening 25 while the piston rod 24 slides through the bushing 23 located within the opening 108 and emerges in the opposite annular cavity 20. Each piston-vane remains in the continuous contact with the two inclined planes 40. The widths of the openings 46 and 47 are such that the remaining solid portions on the walls 40 provide adequate support for the small inclined ends 69. The cylindrical sleeve 14 has openings 109 between two adjacent cylinders 21, these openings communicating with the annular space surrounding the centre boom 4 and hence with the ports 12 and 106.

The ports 31 in each cylinder 21, near the small openings 108 came in cyclic contact with their corresponding pair of ports 11–12 and 105–106 and allow the admission and expulsion of the gas as previously described. The oil from the pump is delivered under pressure to each oil inlet fitting 73 on each of the first stage heads and continues its flow through a distribution system which is substantially the same as for the single acting compressor. The radial holes 81, the annular cavity 82 and balancing ring 83 etc . . . exist only at the drive end. The radial holes 86 are made in the annular wall itself (since the covers 22 do not exist) and communicate with the bushings 23 and with the collector sectors 10 and 107.

Figure 4:
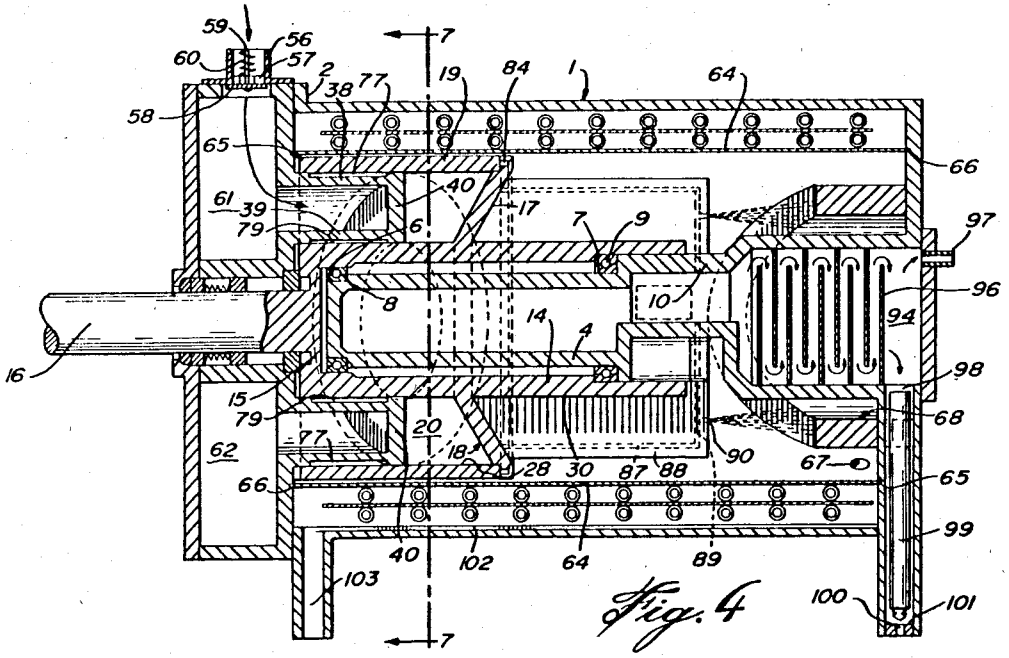
FIG. 4 is a cross-sectional view of the compressor taken along lines 4—4 of FIG. 3.

The first stage head at the non-drive end provides a channel to accommodate the oil discharge arrangement illustrated in FIG. 4 and FIG. 5. The replacement of all six piston-vanes requires complete withdrawal of the rotor; each set is then pulled out from its corresponding large opening end. The already exposed leakage considerations and operation are not repeated since they fully apply to the double acting compressor which such as just described is capable of producing almost twice the output of a "single acting" compressor of same rotor diameter, same inclined plane angle and same rotation speed. The weight/output ration is not quite halved because the rotor is longer and the small cam is replaced with the heavier first stage head. Evidently the casing is also longer but this feature allows for added room to place the additional intercooling coil required to handle the large output. All considered, it is apparent that a "double acting" compressor could be cheaper than the equivalent "single acting" compressor of same output.

SINGLE ACTING COMPRESSOR—SECOND VERSION

A still further verion of the two-stage compressor is shown in FIGS. 13–20. The compressor shown is of the single-acting variety; however, in contrast to the two embodiments previously described wherein the assembly (rotor) in which the piston-vanes are mounted actually rotates about an axis while the inclined cam-defining surfaces are fixed to a stationary casing, the embodiment of FIGS. 13–20 provides for the body or casing assembly in which the piston-vanes are mounted to remain stationary while the assembly which includes the inclined planes or cam defining surfaces rotates along with a "collector" for the second stage output.

The compressor of FIGS. 13–20 does not incorporate an intercooler as with the preceding embodiments; rather, the compressor may be flooded with an oil flow comparable to that used in existing screw compressors to carry away much of the heat generated. This version of the compressor posesses several advantages over and above the two preceding embodiments, which advantages will be enumerated later on; however the basic principles of operation are essentially the same for all versions, as will become apparent from the following description.

Referring again to the drawings at FIGS. 13–20, there is shown a stationary casing 120 having a rotor assembly 122 mounted therein, which assembly comprises a first stage head 124 adjacent the front end of the compressor bolted to one end of an axially extending shaft 126 (defining rotation axis A—A) via radial flange 123, and a rear cam 129, in the form of an inclined flat plate, being rigidly keyed to hub portion 140 of the collector which, in turn, is keyed to shaft 126. A second stage collector 130, to be described later, is also keyed to shaft 126 and forms a part of the rotor assembly 122.

Figure 13:
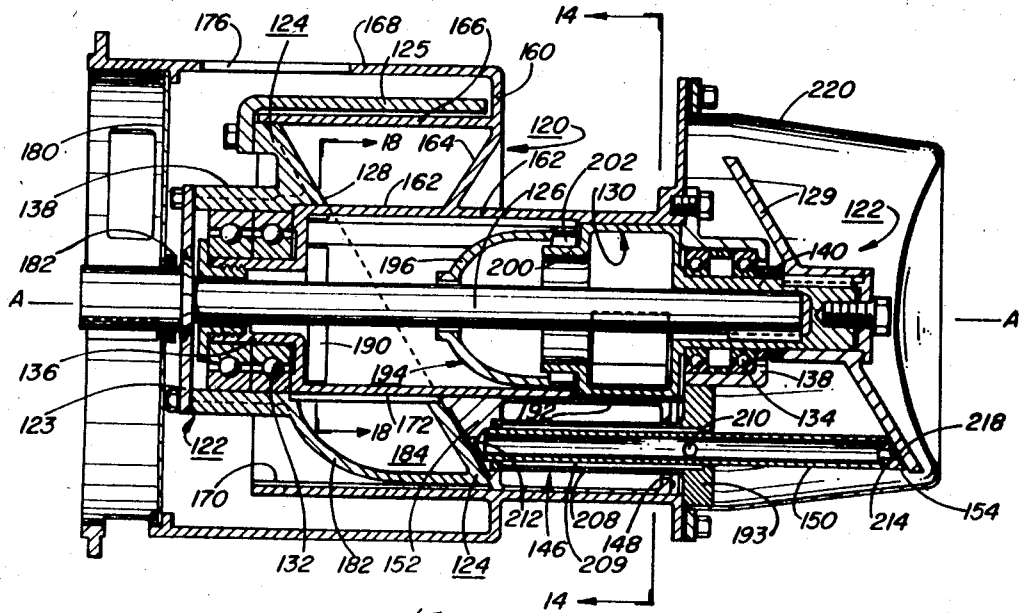
FIG. 13 is a longitudinal section view of a second version of a single acting two-stage compressor made in accordance with the principles of the present invention.

The head 124 is of circular outline and includes a planar camming surface 128, inclined to the rotation axis A—A by a selected angle as described in the previous embodiments, and being parallel to the camming surface defined by the rear cam 129. The rotor assembly 122 is mounted for rotation on front and rear bearing assemblies 132 and 134, the front bearing 132 being located in an annular region between a neck portion 136 of casing 120 and an annular collar portion 138 of the first stage head 124. To take up the thrust forces, a front bearing retainer nut 137 is threaded into neck portion 136 of the casing. The rear bearing 134 is located in the annular space defined between rear bearing housing 138 and the hub portion 140 of collector 130, on which hub portion 140 the rear plate cam 129 is also mounted. To balance the rotating head 124, a counterweight 125 is bolted thereto as best seen in FIG. 13.

Figure 14:
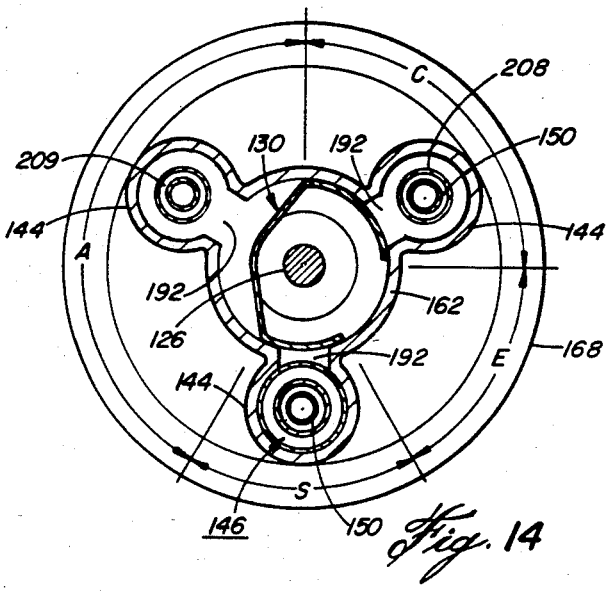
FIG. 14 is a cross-section view taken along line 14—14 of FIG. 13.

The casing 120, as best seen in FIG. 14 includes three outwardly projecting second stage cylinders 144 which are equally angularly spaced about the rotation axis A—A at equal radial distance therefrom and which extend parallel thereto. Disposed in each of the cylinders 144 is a piston-vane 146 similar to that described previously. Each piston-vane 146 is of circular cross section for reciprocating and rotating motion in its associated cylindrical bore, which it sealingly engages. Each piston-vane 146 has a second stage end 148 normal to the reciprocation axis with a piston rod 150 projecting rearwardly therefrom, and a first stage end 152 inclined at an angle to axis A—A equal to the angle of incline of plane surface 128 of head 124. The rear end of piston-rod 150 also has an inclined end part 154 to mate with the plane surface of rear cam 129. Hence, each piston-vane is closely confined between the inclined surface 128 of head 124 and the inclined surface of cam 129. Thus, for each revolution of rotor assembly 122, each piston-vane 146 executes a complete back and forth stroke in the axial direction and also a complete rotation about its own axis. The inclined surface 128 thus also functions as a cam together with cam 129 to control the motion of the piston-vanes.

The casing 120 includes an enlarged front end annular compartment 160 which surrounds and is integrally formed with cylindrical center casing portion 162. Compartment 160 includes a frustro conical wall 164, the apex angle of which matches the angle of incline of the surface 128, the frustro-conical wall 164 being interrupted by the three parallel bores in which the piston-vanes 146 are mounted. As noted in relation to the preceding embodiments, the inclined plane surface 128 carries at its "highest" point, a shallow conical radial recess 165 of a width inferior to the diameter of the cylinder bores. When assembled, the inclined planar surface 128 of the first stage head and the conical wall 164 of the casing remain in continuous sliding and sealing contact at said radial recess 165 as the rotor assembly 122 rotates. Compartment 160 also includes a pair of radially spaced apart walls i.e. inner wall 166 and outer wall 168. The inner wall 166 surrounds the front section of cylindrical casing portion 162, and as the piston-vanes 146 move forwardly, they sealingly engage the walls 162 and 166, shallow circular arc recesses 170 and 172 being formed in these walls for that purpose as described with the preceding embodiments. The circular outer periphery of head 124 also slidably and sealingly engages the inner surface of wall 166 to prevent leakage there between, and, similarly the interior wall 188 of head 124 slidably and sealingly engages the outer frontal section of casing portion 162.

The first stage head 124 also includes, in its inclined planar surface 128, the inlet and exit ports for the first stage. The inlet ports 174 comprise a radially spaced pair of arcuate slots located to one side of the radial recess 165 and each being of sufficient angular extent as to allow inlet gas to enter the first stage working chambers defined between the adjacent piston-vanes 146, conical wall 164 and inclined surface 128, as the head 124 rotates in the direction of arrow B. The inlet gas enters the compartment 160 via an inlet opening 176 in outer compartment wall 168; from there it travels around the front of the head 124 and simply enters through the ports 174 and thence enters the working chambers. The inlet gas could also enter into compartment 160 in the axial direction; however, in the embodiment shown, a circular facing plate 180 is secured to a flange on the inside of the annular wall 168 and a central seal 182 ensures that all gas is drawn through inlet 176. Suitable filtration means, (not shown) ensure that the incoming gas is free of contaminants.

Figure 15:
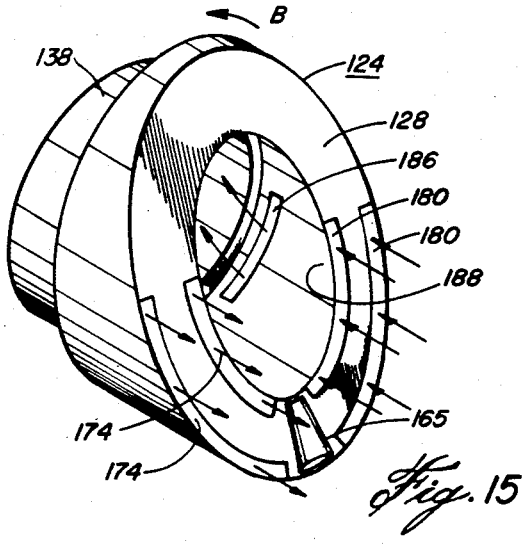
FIG. 15 is a perspective view of the rotating cam means which also contains the first stage inlet and outlet ports.

The first stage outlet arrangement is somewhat more complex. As seen in FIG. 15 the head 124 is provided, on the other side of radial recess 165, with a radially spaced apart pair of arcuate exit ports 180 of sufficient angular extent as to ensure that the pressurized first stage gas can be virtually entirely removed in each cycle to provide for good volumetric efficiency. The sealing "sweeping" action provided by the radial sealing recess 165 (which avoids the problems associated with simple single line contact between the inclined head surface 128 and conical wall 164) effectively removes virtually all of the compressed gas from the first stage in each rotation cycle and assists in ensuring high volumetric efficiency.

The compressed fluid exiting via the ports 180 is then delivered to the interior of the cylindrical central portion 162 of the casing 120. To provide this action, the head 124 includes a forwardly extending arcuate wall 182 which defines an enclosed chamber 184 providing communication between exit ports 180 and a further exit port 186 (FIG. 15) formed in a cylindrical interior wall 188 of the head 124. This interior wall is in close sliding and sealing contact with the frontal part of the cylindrical center portion 162 of casing 120. This portion 162 has three arcuate ports 190 (FIG. 18) defined therein which allow the first stage output fluid to enter into the interior of the casing portion 162 and to travel along in the axial direction to the inlet-exit ports of the second stage cylinders 144.

As with the preceding embodiments, each second stage cylinder is provided with a single inlet-exit port 192 (FIGS. 13 and 14). The manner in which these co-operate with the rotating collector 130 will now be described. From FIGS. 13 and 14 it will be clear that the inlet-exit ports 192 extend through the cylinder walls and into the interior of the central casing portion 162, the inlet-exit ports 192 being located adjacent the rear ends of the cylinders 144 so that as the piston-vanes 146 complete their compression strokes and come into close proximity with the cylinder end covers 193, virtually all of the gas can be forced out of the cylinders thereby to provide high volumetric efficiency. The collector 130, having the general cross-sectional shape shown in FIG. 14, rotates within central casing portion 162 in close sealing engagement with the interior wall of same, so as to co-operate with inlet-exit ports 192 and control the admission, compression and release of fluid from the second stage cylinders.

In FIG. 14 the collector 130 is shown having four main sectors namely an admission sector A, a compression sector C, an exhaust sector E, and a sealing sector S. The admission sector A is shaped such that in this region the collector outer wall is well spaced from the interior wall of central casing portion 162. This enables the first state output fluid within the central casing portion 162 to gain admission to each cylinder via its associated inlet-exit port 192 in turn as the collector 130 rotates and the corresponding piston-vane 146 moves forwardly to admit the fluid. As the piston-vane 146 reverses its motion the compression sector C moves over the corresponding port 192 and the fluid in such cylinder is compressed, following which the exhaust sector E comes into communication with the inlet exit port 192 to release the compressed second stage fluid. The sealing sector S is of sufficient angular extent as to prevent leakage of fluid from the high pressure second stage exhaust side to the lower intermediate stage pressure side. Hence, as the rotor assembly 122 turns about its axis, the intermediate stage fluid is admitted, compressed and released from each of the cylinders 144 in turn.

Figure 19:
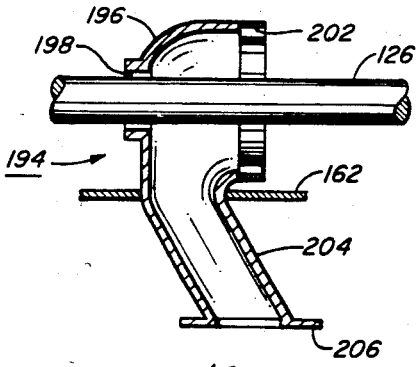
FIG. 19 is a longitudinal section view of the second stage discharge duct.
Figure 20:
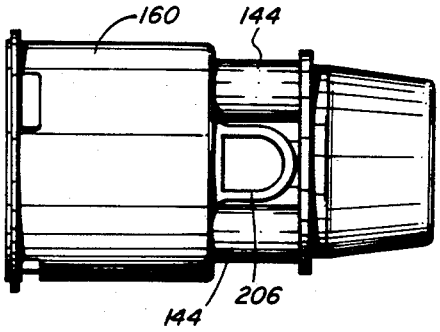
FIG. 20 is a side elevation view of the compressor exterior looking toward the second stage outlet.

The compressed second stage fluid enters into the open exhaust sector E of the rotating collector and thence proceeds into a fixed discharge duct 194. The discharge duct 194 is shown in FIGS. 13 and 19 and includes a bowl shaped portion 196 which encompasses the shaft 126 in sealed engagement therewith via seal 198. The collector 130 has a short forwardly projecting neck 200, which sealingly engages the open mouth of discharge duct 194 via an annular seal 202. The discharge duct includes a conduit portion 204 which extends radially outwardly away from the central axis, passes through the cylindrical center portion 162 of the casing between an adjacent pair of the cylinders 144, thence terminating in an outlet flange 206 (shown in FIG. 20) which can be bolted to a suitable conduit (not shown).

With reference again to the drawings, FIGS. 13, 14, 16 and 17 show oil passage means associated with the piston-vanes 146 to supply oil thereto to provide an oil cushion at each of the opposing ends of the piston-vanes thereby to reduce the amount of friction and wear. In FIG. 13 it will be seen that each cylinder end cap 193 includes a forwardly extending annular sleeve 208 which surrounds and defines an annular space 209 between itself and the piston rod 150. Piston rod 150 includes an oil inlet hole 210 through which oil is admitted under pressure from the annular space 209. Since the piston rod 150 is hollow and since the first stage end 152 and the rod end 154 are both provided with oil outlets 212 and 214, oil is admitted to the interfaces between the inclined planar cam surface 128 of the head 124 and the piston-vane end 152 as well as to the interface between the rear cam plate 129 and the rod end 154. At both of these ends 152 and 154, shallow circular recesses 216 and 218 are formed which enhance the oil cushion effect and prevent metal-to-metal contact under the high inertia and high pressure loadings encountered at high speed and high pressure operation. The diameter of recess 216 is of course selected so that the oil pressure is not lost when the piston vane end transverses the inlet and exit ports 174, 180 in the first stage head.

Figure 16:
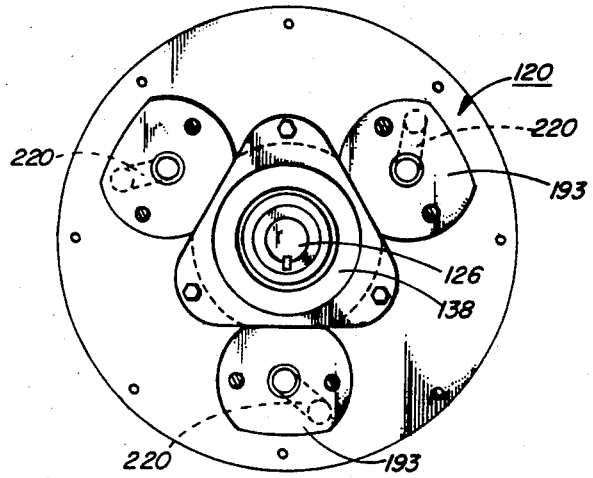
FIG. 16 is a rear view of the two-stage compressor FIG. 13 as it appears with the cover pan and rear cam removed.
Figure 17:
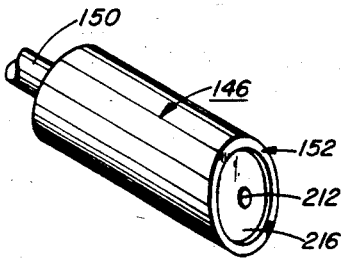
FIG. 17 is a perspective view of a front end portion of one of the piston-vanes.
Figure 18:
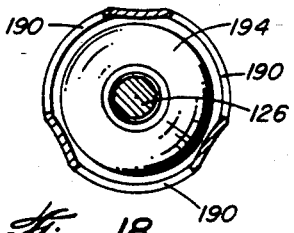
FIG. 18 is a cross-section view taken along line 18—18 appearing FIG. 13.

In order to supply the oil to the annular spaces 209, suitable oil passages 220 are provided in the cylinder end covers 193 as illustrated in phantom in FIG. 16, such oil being supplied via conventional high pressure supply lines (not shown).

In operation of the compressor, additional oil may be introduced at the air intake, possibly in the form of a spray. The total volume of oil may be increased to the desired degree to assist in carrying away some of the heat produced since no provision is made for interstage cooling. A suitable oil return passage (not shown) is provided to return oil collecting inside rear pan 220 to the interior of compartment 160 for readmission into the first stage.

The single acting embodiment of FIGS. 13–20 has advantages over the two embodiments described previously. For example, since the piston-vanes do not rotate about axis A—A, they are not subjected to substantial centrifugal forces and the resulting frictional forces and hence the compressor can be operated at high speeds. Furthermore, access to the piston-vanes is made very easy; the rear cover pan 220, cam plate 129, and cylinder end covers 193 can be quickly removed for repair or inspection. Also, by cushioning the piston-vane ends with the high pressure oil, friction is greatly reduced thus allowing high operating speeds and high pressures.

As noted previously, the apparatus described herein can be modified to act as a fluid motor although its preferred use is as a compressor. When modified to function as a motor, the stages are reversed, i.e. the first stage of the compressor becomes the second stage of the motor and vice versa. Provision for interstage heating can be made if excessive cooling of the expanding fluid takes place.

I claim:

1. A rotary fluid displacement apparatus having first and second stages and comprising:

(a) a first body and a second body, one of which is held stationary;

(b) means defining an axis of relative rotation between said bodies;

(c) a plurality of piston-vanes mounted in said first body for reciprocating movement relative thereto;

(d) the second body having cam means co-acting with said piston-vanes such that the reciprocating movement of said piston-vanes occurs in the course of relative rotation between said bodies about said axis;

(e) one of said stages including a plurality of closed working chambers defined at least in part between adjacent portions of said piston-vanes, said cam means and portions of said first body, and all being arranged such that the volumes of said chambers increase and decrease in cyclical fashion during said relative rotation;

(f) the other stage including a plurality of closed working chambers comprising elongated bores in said first body in each of which a respective one of said piston-vanes is slidably mounted in sealing engagement with the wall of such bore, with the volumes of said last mentioned working chambers varying in cyclical fashion as said piston-vanes reciprocate in said bores during said relative rotation between said bodies;

(g) first and second stage inlet and exit port means for admitting and releasing fluid from the working chambers of the two stages in the course of said relative rotation and means defining a path for transmitting the fluid from the first stage to the second stage of the apparatus.

2. The apparatus of claim 1 wherein said piston-vanes reciprocate in straight-line paths parallel to said axis of relative rotation.

3. The apparatus of claim 2 wherein said piston-vanes are each of circular section to allow for the rotation thereof relative to said first body during the relative rotation between said two bodies.

4. The apparatus of claim 3 wherein said cam means includes a planar surface inclined at a selected angle to the axis of relative rotation, such planar surface slidingly, sealingly engaging end portions of said piston-vanes.

5. Apparatus according to claim 4, wherein the first body has a frustro-conical surface defining a part of the working chambers, with a portion of said frustro-conical surface being in sliding, sealing contact with said inclined planar surface of said cam means.

6. The apparatus of claim 5 wherein said piston-vanes are equally angularly spaced apart around said axis of relative rotation at a substantially equal distance from said axis.

7. The apparatus of claim 1 wherein each said working chamber of the other stage includes a single inlet-exit port therein, and means arranged in sliding, sealing engagement with said inlet-exit ports to selectively open and close the same to admit and release fluid in cyclical fashion during the relative rotation between said first and second bodies.

8. A rotary compressor having first and second stages and comprising:

(a) a first body and a second body, one of which is held stationary;

(b) means defining an axis of relative rotation between said bodies;

(c) a plurality of piston-vanes mounted in said first body for reciprocating movement relative thereto;

(d) the second body having cam means co-acting with said piston-vanes to effect the reciprocating movement in response to relative rotation between said bodies about said axis;

(e) said first stage including a plurality of closed working chambers defined at least in part between adjacent portions of said piston-vanes, said cam means and portions of said first body, and all being arranged such that the volumes of said chambers increase and decrease in cyclical fashion during said relative rotation;

(f) said second stage including a plurality of closed working chambers comprising elongaged bores in said first body in each of which a respective one of said piston-vanes is slidably mounted in sealing engagement with the wall of such bore, with the volumes of said second stage working chambers varying in cyclical fashion as said piston-vanes reciprocate in said bores during said relative rotation between said bodies;

(g) first and second stage inlet and exit port means for admitting and releasing fluid from said first and second stage working chambers in response to said relative rotation and means defining a path for transmitting the fluid from the first stage to the second stage of the compressor.

9. The compressor of claim 8 wherein said piston-vanes reciprocate in straight-line paths parallel to said axis of relative rotation.

10. The compressor of claim 9 wherein said piston-vanes are each of circular section to allow for the rotation thereof relative to said first body during the relative rotation between said two bodies.

11. The compressor of claim 10 wherein said cam means includes a planar surface inclined at a selected angle to the axis of relative rotation, such planar surface slidingly, sealingly engaging end portions of said piston-vanes.

12. The compressor of claim 11 wherein said cam means are arranged to engage opposing ends of each of said piston-vanes to effect the relative reciprocating motion thereof during said relative rotation.

13. The compressor of claim 11 wherein the first body has a frustro-conical surface defining a part of the working chambers, with a portion of said frustro-conical surface being in sliding, sealing contact with said inclined planar surface of said cam means.

14. The compressor of claim 13 wherein said piston-vanes are equally angularly spaced apart around said axis of relative rotation at a substantially equal distance from said axis.

15. The compressor of claim 10 wherein said cam means includes a planar surface inclined at a selected angle to said axis of relative rotation, and wherein said first stage working chambers are defined in part by the inclined planar surface of said cam means with said piston-vanes each having inclined ends adapted to remain in continuous sliding contact with said inclined planar surface.

16. The compressor of claim 15 wherein said first stage inlet and exit ports are defined in said inclined planar surface with the flow of fluid therethrough being controlled as the inclined ends of the piston-vanes slide thereover.

17. The compressor according to claim 13 wherein said planar surface is defined by a first stage head, said cam means further including an inclined cam plate parallel to said planar surface, said piston-vanes being confined between said planar surface and said inclined cam plate.

18. The compressor according to claim 17 wherein means are provided for closing the ends of the bores of said second stage working chambers, each of said piston-vanes including two coaxial adjoining portions of different outside diameters, the larger portion being substantially equal to the inside diameter of the elongated bore and the smaller portion traversing said end closure means of said bore; said piston-vane portions having free ends lying in planes parallel to each other and inclined with respect to the common longitudinal axis thereof, the other end of said larger portion being perpendicular to said axis and coming into close proximity to the end closure means during operation to provide good volumetric efficiency.

19. The compressor according to claim 18 wherein the inclined end of said larger portion remains in substantially continuous sliding contact with the inclined planar camming surface of said first-stage head, the inclined end of said smaller portion remaining in substantially continuous sliding contact with said inclined cam plate; the relative rotation between said bodies causing the rotation of said piston-vanes around their own axes and their longitudinal reciprocation in said bores.

20. The compressor of claim 11 wherein each said second stage working chamber includes a single inlet-exit port therein, and means arranged in sliding, sealing engagement with said inlet-exit ports to selectively open and close the same to admit fluid from said first stage and to release fluid therefrom to said second stage outlet means in cyclical fashion during the relative rotation between said first and second bodies.

21. The compressor of claim 20 wherein said means to selectively open and close said inlet-exit ports comprises a hollow collector located at said axis of relative rotation and having angularly arranged admission, compression, exhaust and sealing sectors which cooperate with the inlet-exit ports of said cylinders.

22. The compressor according to claim 20 wherein said first body in which said piston-vanes are mounted is a rotor and said second body having said cam means is fixed in position during operation.

23. The compressor of claim 22 wherein said second body includes a casing and said cam means are located adjacent opposite ends of said casing, and an axially extending shaft connected to said rotor for driving the same.

24. The compressor of claim 22 wherein said fixed second body includes an axially extending boom about which said rotor revolves, and said boom having openings therein providing said means for selectively admitting and releasing fluid from said second stage working chambers.

25. The compressor of claim 22 wherein means are provided for cooling said fluid between said stages, said means including an annular coil surrounding said rotor.

26. A double acting two-stage compressor according to claim 23 including two sets of said piston-vanes, the first and second said sets co-operating with respective ones of said cam means at the opposite ends of said casing such that first stage working chambers are defined adjacent each of said opposing ends of the casing.

27. The compressor according to claim 11 wherein said first body in which said piston-vanes are mounted is fixed during operation and said second body having said cam means is a rotor.

28. The compressor according to claim 27 wherein said rotor includes a shaft connected to said cam means for rotating the same to effect the reciprocating motion of the piston-vanes.

29. The compressor of claim 28 wherein each said second stage working chamber includes a single inlet-exit port therein, and means arranged in sliding, sealing engagement with said inlet-exit ports to selectively open and close the same to admit fluid from said first stage and to release fluid therefrom to said second stage outlet means in cyclical fashion during the relative rotation between said first and second bodies, said means to selectively open and close said inlet-exit ports comprises a hollow collector located at said axis of relative rotation and having angularly arranged admission, compression, exhaust and sealing sectors which cooperate with the inlet-exit ports of said cylinders.

30. The compressor of claim 8 wherein each of said elongated bores has a removable end cap thereon arranged to permit said piston-vanes to be individually removed without disassembly of the first stage of the compressor.

31. The compressor of claim 11 including oil passage means for supplying pressurized oil to the interior of each said piston-vane, and each piston-vane having an opening in its end portion which slidably engages said inclined planar surface to supply a cushion of oil to the interface between said end portion and planar surface.

* * * * *